US005155911A

United States Patent [19]

Collins

[11] Patent Number: 5,155,911

[45] Date of Patent: Oct. 20, 1992

[54] KNIFE AND SHEATH LOCKING MECHANISM

[76] Inventor: Walter W. Collins, P.O. Box 100, North, S.C. 29112

[21] Appl. No.: 788,576

[22] Filed: Nov. 6, 1991

[51] Int. Cl.[5] ..... B26B 3/06

[52] U.S. Cl. ..... 30/162; 30/151; 224/232

[58] Field of Search ..... 30/162, 151; 224/232, 224/247, 253

[56] References Cited

U.S. PATENT DOCUMENTS

| | | | |
|---|---|---|---|
| 2,439,197 | 4/1948 | Wykoff | 30/151 |
| 2,783,536 | 3/1957 | McQueary | 30/151 |
| 2,859,516 | 11/1958 | McQueary | 30/151 |
| 2,901,823 | 9/1959 | Widen | 224/232 |
| 3,363,813 | 1/1968 | Eastman | 224/2 |
| 3,514,022 | 5/1970 | Eastman | 224/232 |
| 3,576,278 | 4/1971 | Eastman | 224/232 |
| 4,211,003 | 7/1980 | Collins | 224/232 |
| 4,404,747 | 9/1983 | Collins | 30/151 |
| 4,856,192 | 8/1989 | Collins | 30/151 |

*Primary Examiner*—Frank T. Yost
*Assistant Examiner*—Hwei-Siu Payer
*Attorney, Agent, or Firm*—Michael A. Mann

[57] ABSTRACT

A knife and sheath with a locking mechanism. The knife has a blade with a tang and a handle with a channel to receive the tang. Holes in the tang and the handle align to receive a threaded post which also secures the stud of a snap fastener to the front of the handle. The sheath has a blade-enclosing section and a pouch section that encloses and frictionally holds a portion of the handle. The pouch has two arms that encircle that portion from front to rear. The pouch section carries the socket of the snap fastener, preferably on a longitudinal section on the front of the sheath, so that the knife may be secured in the sheath by simply snapping the socket to the stud, and be released by unsnapping.

13 Claims, 2 Drawing Sheets

KNIFE AND SHEATH LOCKING MECHANISM

BACKGROUND OF THE INVENTION

1. Field of the Invention

The present invention relates to sheath knives. More particularly, the present invention relates to mechanisms for locking or securing a knife in a sheath.

2. Discussion of Background

Knives and sheaths for holding knives are well known. Numerous locking mechanisms have been designed to secure a knife in a sheath as protection against injury or as a safeguard against loss. Locking mechanisms are usually a compromise between ease of use on the one hand, and effectiveness of the lock on the other because all too frequently the more effective the locking mechanism, the more difficult it is to operate. Furthermore, it is frequently the case that the locking mechanism adds to the complexity, and therefore the cost, of the knife and sheath assembly. There is a need for a simple, positive locking mechanism that does not add unduly to the cost of manufacturing and yet is easy to use and effectively secures the knife within the sheath.

A number of attempts have been made to meet this need. See for example, Eastman's three U.S. Pat. Nos. 3,576,278, 3,514,022, and 3,363,813 which have snap fasteners that attach to the butt of the handle. See also the U.S. patent issued to Wykoff, U.S. Pat. No. 2,439,197 which also has a snap fastener on the back of the handle that attaches to the upper part of the sheath, above the blade-enclosing part of the sheath. A knife made according to this design must be rotated away from the body using the point of the blade as a fulcrum against the leg of the wearer in order to unsnap the fastener.

SUMMARY OF THE INVENTION

According to its major aspects, the present invention is an article of manufacture comprising a knife and a sheath. The knife has a blade with a tang and a handle. The handle has a channel formed therein, dimensioned for receiving the tang of the blade. Holes in both the tang and the handle align when the tang is fully seated in the channel to receive a post for securing the blade to the handle. The sheath has a blade-enclosing section and an adjacent pouch section integral with the blade-enclosing section for enclosing a portion of the handle. The pouch section has a pair of arms that fold around the sides and the back of the handle, and a longitudinal section that extends partway up the handle and carries the socket part of a snap fastener. The stud part of the snap fastener is attached to the handle by the post. Thus, the post has a double function: it holds the stud and the blade to the handle. Since the stud is on the front of the handle, i.e. away from the body of the user, the snap is unsnapped simply by placing the thumb between the longitudinal portion of the pouch and the handle and pushing outwardly.

The pouch has three functions. It provides a frictional fit to keep the knife snug in the sheath so that the blade is moving up and down. The arms allow adjustments of the dimensions of the pouch interior so that differently sized handles can be accommodated by the same pouch, a distinct advantage in manufacturing. Finally, in the interior of the sheath is a welt, to provide a separation between front and back layers of the blade-enclosing section so that the blade will fit better. Because of the pouch, the welt extends only up to the top of the blade so the top of the welt will act as a stop for the knife as the bottom of the handle engages the top of the welt.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
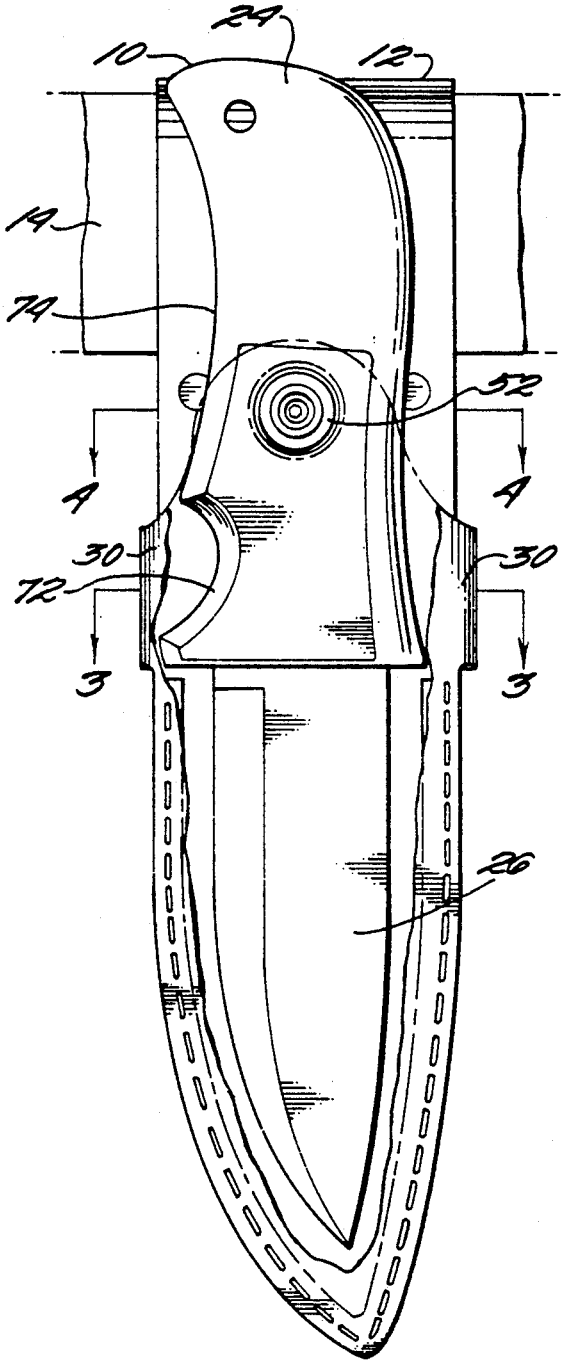
FIG. 1 is a partially cut away front view of the knife and sheath according to a preferred embodiment of the present invention.
Figure 2:
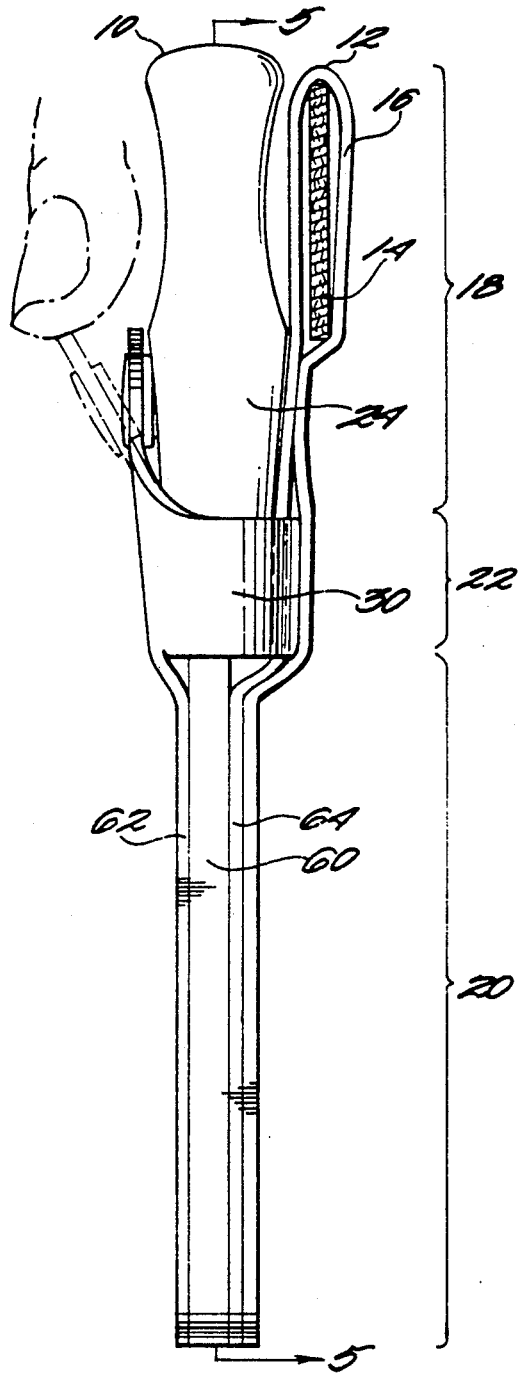
FIG. 2 is a side view of the knife and sheath shown in FIG. 1.

Referring now to FIGS. 1 and 2, there is illustrated a knife 10 and a sheath 12 according to a preferred embodiment of the present invention. FIG. 1 shows a front view; FIG. 2 shows a view from the right side of the knife 10/sheath 12 of FIG. 1. Knife 10 is seated in sheath 12 which is carried from a belt 14, worn by the user. Belt 14 passes through a loop 16 formed in the upper section 18 of sheath 12. The "front" of knife 10/sheath 12 means the side away from the wearer; "back" means the side against the wearer.

Sheath 12 has a lower or blade-enclosing section 20 and a pouch section 22 preferably integral with blade-enclosing section 20. Knife 10 has a handle 24 and a blade 26. Pouch section 22 encloses a portion of handle 24.

Figure 3:
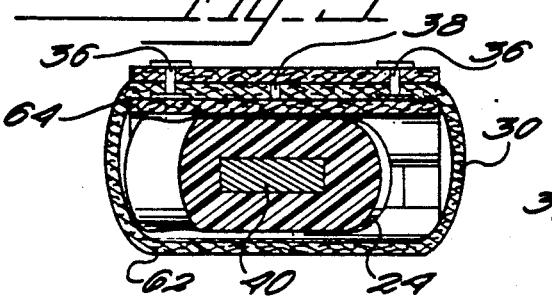
FIG. 3 is a cross sectional view of the knife and sheath shown in FIG. 1, taken along line 3—3.

Pouch section 22 has a pair of arms 30 that go around the sides of sheath 12 and encircle or nearly encircle the back of handle 24 (see FIG. 3). Pouch section 22 has a longitudinal portion 32 that extends a distance above and generally perpendicular to arms 30. Longitudinal portion 32, which may be integral with pouch section or be attached thereto, carries part of a snap fastener 34, to be more fully described below, that snaps to handle 24. Arms 30 are fastened to the back of sheath 12 preferably by rivets 36 (FIG. 3). Pouch section 22 is preferably sized so that a gap 38 exists between the ends of arms 30. If sheath 12 is to be used for knives having different handle shapes and sizes, the size of gap 38 can be varied so that pouch section 22 always frictionally engages the portion of handle 24 enclosed by pouch section 22.

Figure 4:
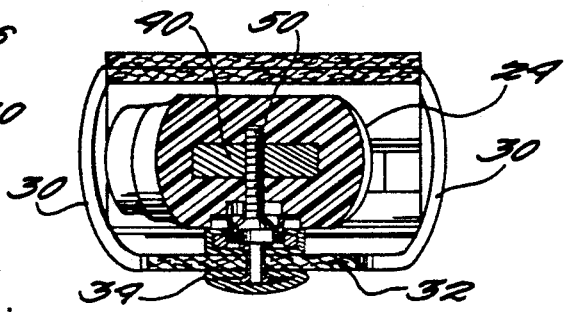
FIG. 4 is a cross sectional view of the knife and sheath shown in FIG. 1, taken along line 4—4.
Figure 5:
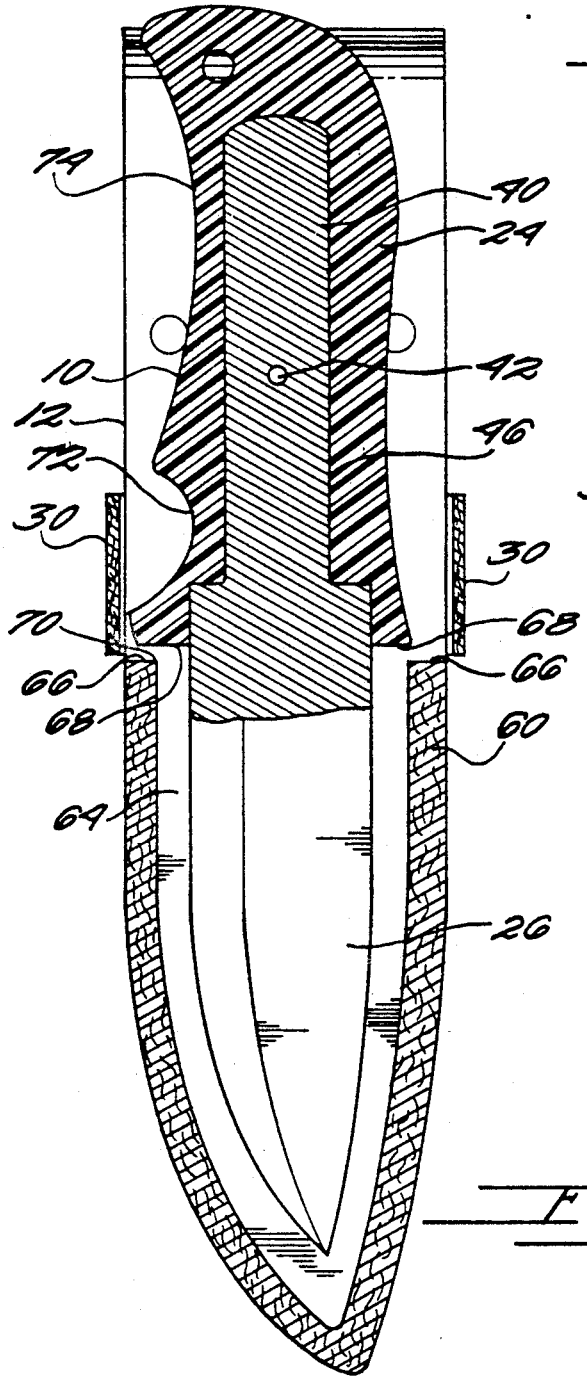
FIG. 5 is a frontal, cross sectional view of the knife and sheath of FIG. 2, taken along line 5—5.

Referring now to FIGS. 4 and 5, blade 26 has a tang 40 with a hole 42. Handle 24 also has a hole 44 and a channel 46. Channel 46 is dimensioned to receive tang 40 and, when tang 40 is fully seated in channel 46, holes 42 and 44 align and receive a post 50 that secures tang 40 in channel 46 and thus blade 26 to handle 24. Post 50 and holes 42 and 44 are preferably threaded and post 50 extends across channel 46 to seat in handle 24 on either side of channel 46.

Figure 6:
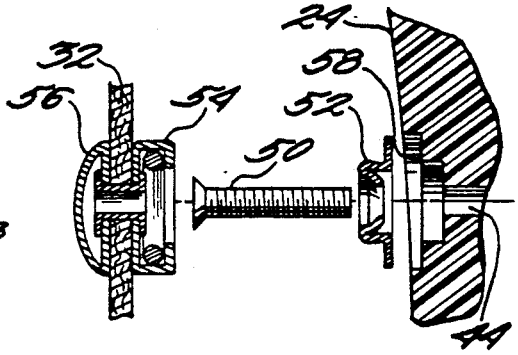
FIG. 6 is a detailed, exploded view of the locking mechanism according to a preferred embodiment of the present invention.

Post 50, in addition to securing blade 26 to handle 24, attaches a part of snap fastener 34 to handle 24, namely and preferably, a stud 52. FIG. 6 shows an exploded view of the parts of snap fastener 34. The other parts of snap fastener 34 are carried by longitudinal portion 32. These include a socket 54 and a cap 56. Socket 54 engages or snaps to stud 52; cap 56 finishes or covers socket 54. Preferably, a recess 58 is made in the front of handle 24 so that stud 52 will be flush with the surface of handle 24. Clearly, from a functional standpoint, having socket 54 attached to handle 24 and stud 52 to longitudinal portion 32 would be equivalent to the embodiment shown.

To release knife 10, the thumb (FIG. 2) is pressed against the top longitudinal portion 32 in a direction down and away from knife 10 to unsnap snap fastener 34. To lock knife, cap 56, and with it socket 54, is pressed toward stud 52 until socket 54 snaps into place, providing positive locking of snap fastener 34 and thereby knife 10 into sheath 12.

Inside blade-enclosing section 20 is, in a preferred embodiment, a welt 60 that provides spacing between a front cover 62 and a back cover 64 of blade-enclosing section 20 for blade 26 (see also FIG. 2). Welt 60 has a top 66 that extends only to the top of blade-enclosing section and not into pouch section 22. When knife 10 is inserted into sheath 12, the bottom 68 of handle 24 will engage the top 66 of welt, whereby further insertion of knife 10 is stopped. If blade-enclosing section 20 is formed by folding material rather than fastening a front piece to a back piece, then welt 60 may be unnecessary. In such a case, bottom 68 of handle 24 can be stopped by a rivet, or equivalent, fastened at the top of blade-enclosing section at a point 70.

Preferably, sheath may be made of any durable, foldable or moldable material such as leather or most preferably a fabric laminant such as "BONTEX" or "CORDURA". Handle 24 is preferably made of a molded, high impact plastic, most preferably, of a fiberglass-filled "NYLON". If handle 24 is made of a molded plastic, channel 46 runs preferably a major portion of the length of handle 24 so that there are no large masses of plastic to cool. Avoiding large masses of plastic prevents sinking as the plastic contracts on cooling. Handle 24 is also preferably ergometricly formed with a deep index finger curve 72 and a single curve 74 for the remaining three fingers.

It will be apparent to those skilled in the art that many changes and substitutions can be made to the preferred embodiment herein described without departing from the spirit and scope of the present invention which is defined by the appended claims.

What is claimed is:

1. An article, comprising:

a knife having a blade with a tang, a handle with a channel formed therein dimensioned to receive said tang, said handle having a front and a back, means for securing said tang within said channel; and a sheath having a front and an opposing back, a belt loop extending from said opposing back, a blade-enclosing section dimensioned to receive said blade of said knife, a pouch section adjacent to said blade-enclosing section dimensioned to receive a portion of said handle, means for locking said sheath to said securing means so that said blade is releasibly held in said blade-enclosing section, and a longitudinal flap on said front of said sheath extending from said pouch said longitudinal flap carrying said locking means.

2. The article as recited in claim 1, wherein said locking means further comprises a socket carried by said longitudinal flap and a stud carried by said handle and positioned so that said socket can be releasibly snapped to said stud.

3. The article as recited in claim 1, wherein said pouch section further comprises:

a pair of side flaps that fold around said portion of said handle from said front to said back of said sheath.

4. An article, comprising:

a knife having a blade with a tang, a hole formed in said tang, a handle with a channel formed therein dimensioned to receive said tang, said handle having a front and an opposing back and a hole formed in said front and alignable with said hole in said tang, a post dimensioned to fit into said holes in said handle and said tang, thereby securing said tang in said channel; and a sheath having a front and an opposing back, a blade-enclosing section dimensioned to receive said blade of said knife, means for locking said sheath to said post so that said blade is releasibly held in said blade-enclosing section, and a pouch section integral with and adjacent to said blade-enclosing section and dimensioned to receive a portion of said handle, frictionally holding said portion in said sheath, said pouch section having a pair of side flaps that fold around said portion of said handle from said front to said back of said sheath and attached to said back of said sheath.

5. The article as recited in claim 4, wherein said locking means further comprises a socket carried by said sheath and a stud carried by said post, said socket releasibly attachable to said stud.

6. The article as recited in claim 5, wherein said pouch section has a longitudinal flap for carrying said socket.

7. An article, comprising:

a knife having a handle having a front and an opposing back, a blade attached to said handle; and a sheath having a front and an opposing back, a blade-enclosing section dimensioned to receive said blade of said knife, means for locking said sheath to said front of said handle so that said blade is releasibly held in said blade-enclosing section, and a pouch section adjacent said blade-enclosing section dimensioned to receive a portion of said handle and wherein said sheath has a welt in said blade enclosing portion but not in said pouch section so that said welt engages said handle when said blade is seated in said blade-enclosing section.

8. The article as recited in claim 7, wherein said locking means comprises:

a socket attached to said sheath; and a stud attached to said handle, said socket releasibly attachable to said stud.

9. The article as recited in claim 8, wherein said stud is secured to said handle by a post.

10. The article as recited in claim 9, wherein said blade has a tang with a hole and said handle has a channel for receiving said tang and a hole in said front of said handle and aligned with said hole in said tang when said tang is in said channel, and said post is positioned in said holes in said handle and said tang thereby securing said stud to said handle and said tang in said channel.

11. The article as recited in claim 10, wherein said pouch section carries said socket.

12. The article as recited in claim 11, wherein said pouch section has a pair of side flaps that fold around said portion of said handle from said front to said back of said sheath.

13. The article as recited in claim 7, wherein said locking means comprises:

a stud attached to said sheath; and a socket attached to said handle, said socket releasibly attachable to said stud.

* * * * *